US005977757A

United States Patent [19]

Felps

[11] Patent Number: 5,977,757

[45] Date of Patent: Nov. 2, 1999

[54] POWER SUPPLY HAVING AUTOMATIC VOLTAGE SENSING

[75] Inventor: Jimmie D. Felps, Colorado Springs, Colo.

[73] Assignee: Hewlett-Packard Company, Palo Alto, Calif.

[21] Appl. No.: 09/184,473

[22] Filed: Nov. 2, 1998

[51] Int. Cl.[6] ..... G05F 1/56

[52] U.S. Cl. ..... 323/282; 323/285

[58] Field of Search ..... 323/265, 266, 323/282, 284, 285; 361/18

[56] References Cited

U.S. PATENT DOCUMENTS

| | | | |
|---|---|---|---|
| 4,451,778 | 5/1984 | Fischer et al. | 323/282 |
| 5,680,036 | 10/1997 | Faulk | 323/282 |
| 5,734,259 | 3/1998 | Sisson et al. | 323/282 |
| 5,889,393 | 3/1999 | Wrathall | 323/282 |

OTHER PUBLICATIONS

J. D. Felps, "Automatic Local Sensing Improves Regulation", EDN, Jan. 4, 1996, pp. 102 & 104.

Burr–Brown IC Data Book–Linear Products, "Precision Instrumentation Amplifier", pp. 4.77–4.479.

*Primary Examiner*—Matthew Nguyen

[57] ABSTRACT

A power supply includes a voltage regulator for generating a regulated voltage in response to an input voltage and an error signal, first and second output terminals connected to the voltage regulator for coupling the power supply to a load, first and second sense terminals and a sensing circuit for generating the error signal. The sensing circuit includes a high input impedance differential amplifier having first and second inputs respectively coupled to the first and second sense terminals for measuring a sense voltage between the sense terminals. The power supply may be operated in a remote sensing mode or in a local sensing mode. In the local sensing mode, no connections are required between the sense terminals and the output terminals.

15 Claims, 3 Drawing Sheets

POWER SUPPLY HAVING AUTOMATIC VOLTAGE SENSING

FIELD OF THE INVENTION

This invention relates to power supplies and, more particularly, to power supplies which perform automatic local sensing.

BACKGROUND OF THE INVENTION

Typical laboratory power supplies use local voltage sensing, in which the output voltage is regulated at the output terminals on the power supply. A laboratory power supply that uses local sensing is convenient to use, but the voltage across the load is not well regulated because of voltage drops in the power supply leads between the power supply output terminals and the load. The voltage drop depends on the resistance of the power supply leads and the current drawn by the load.

Precision laboratory power supplies may include a remote sensing feature that regulates the voltage at the load. In such supplies, sense terminals on the power supply are connected to the load separately from the current-carrying connections. Precision laboratory power supplies may also be set up for local sensing by connecting the sense terminals to the power supply output terminals. This type of power supply is inconvenient to use as a locally sensed power supply, because it is necessary to connect the sense terminals to the power supply output terminals. Some supplies include resistors connected between the sense terminals and the output terminals. Even when the resistors are present, the current through them is generally high enough to cause poor regulation at the power supply output terminals, if the sense terminals are not connected to the output terminals. Thus, the failure to connect the sense terminals to the output terminals in the locally sensed mode may result in poor regulation and unpredictable behavior.

Another approach to local sensing is disclosed by J. D. Felps in "Automatic Local Sensing Improves Regulation," EDN, Jan. 4, 1996, pages 102–104. A precise current is passed through the resistors that interconnect the sense terminals and the supply output terminals. Thus, the voltage at the power supply output terminals increases by a fixed amount, such as for example 2%, when remote sensing is not utilized. The voltage increase may compensate for the voltage drop through the leads that carry current to the load. This approach permits use of one power supply in multiple products, but is not particularly useful in laboratory power supplies. Accordingly, there is a need for improved sensing circuitry for controlling power supply voltages.

SUMMARY OF THE INVENTION

According to one aspect of the invention, a power supply for supplying a regulated voltage to a load is provided. The power supply comprises a voltage regulator for generating the regulated voltage in response to an input voltage and an error signal, first and second output terminals connected to the voltage regulator for coupling the power supply to the load, first and second sense terminals and a sensing circuit for generating the error signal. The sensing circuit comprises a high input impedance differential amplifier having first and second inputs respectively coupled to the first and second sense terminals for measuring a sense voltage between the sense terminals. The power supply further comprises a first resistor connected between the first output terminal and the first sense terminal, and a second resistor connected between the second output terminal and the second sense terminal.

According to one feature of the invention, the first and second resistors may have values selected to produce a minimal or nearly minimal voltage difference between each of the output terminals and the respective sense terminals when the sense terminals are not connected to the load, and to produce a minimal or nearly minimal voltage difference between each of the sense terminals and respective sides of the load when the sense terminals are connected to the load.

According to another feature of the invention, the differential amplifier may comprise an operational amplifier having first and second inputs, a first buffer amplifier coupled between the first sense terminal and the first input of the operational amplifier and a second buffer amplifier coupled between the second sense terminal and the second input of the operational amplifier. The differential amplifier may comprise an instrumentation amplifier. Preferably, the differential amplifier requires bias currents to the first and second inputs less than about 25 nanoamps.

According to a further feature of the invention, the first and second resistors have values selected to produce a voltage difference less than about 250 microvolts between each of the output terminals and the respective sense terminals when the sense terminals are not connected to the load. The first and second resistors preferably have values in a range of about 1 kilohm to 100 kilohms.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
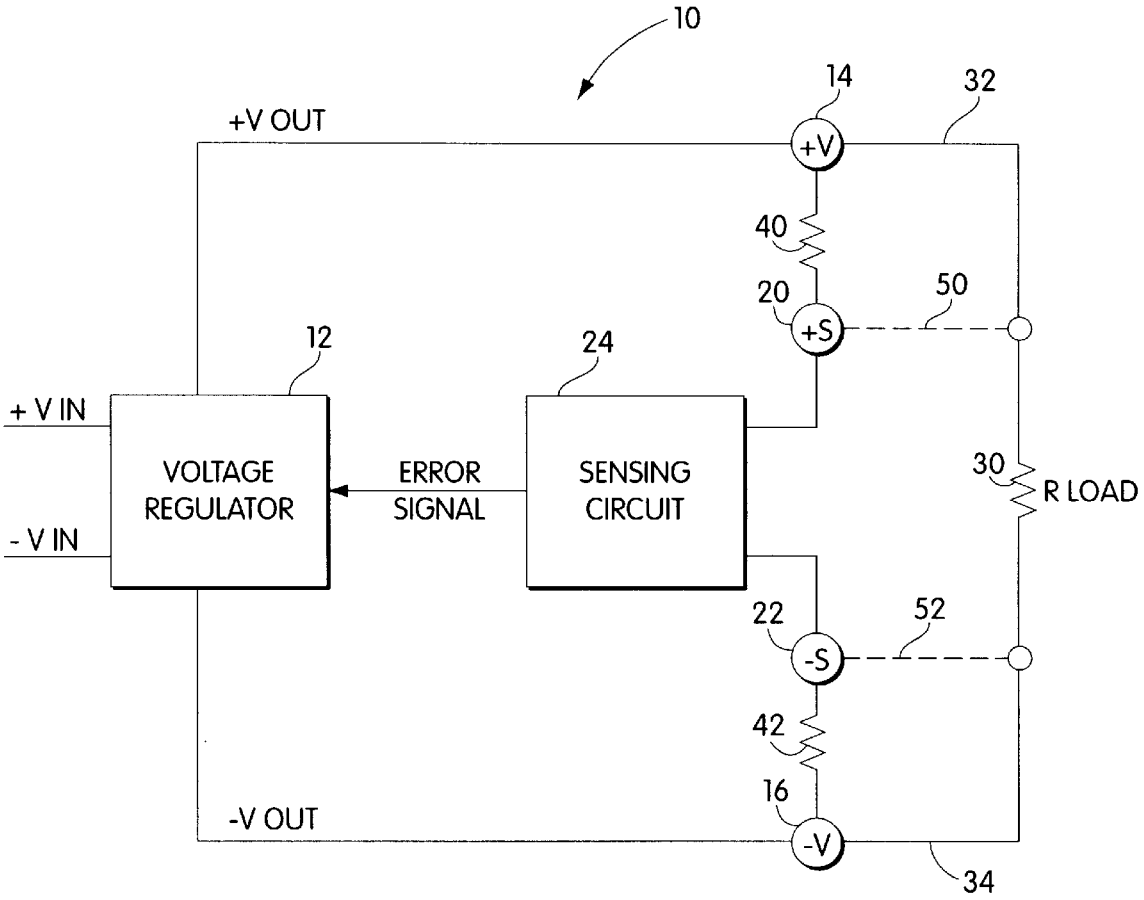
Fig. 1 PRIOR ART
FIG. 1 is a block diagram of a power supply suitable for incorporation of the present invention.

A block diagram of an example of a power supply suitable for incorporation of the present invention is shown in FIG. 1. A power supply 10 includes a voltage regulator 12, output terminals 14 and 16, sense terminals 20 and 22, and a sensing circuit 24. Voltage regulator 12 receives an input voltage +Vin and −Vin and produces a regulated output voltage +Vout and −Vout. The outputs of voltage regulator 12 are connected to output terminals 14 and 16, respectively. Voltage regulator 12 also receives an error signal from sensing circuit 24. The magnitude of the output voltage is controlled by voltage regulator 12 in response to the error signal. Output terminals 14 and 16 may be coupled to a load 30, represented as a resistor $R_{LOAD}$, by power supply leads 32 and 34, respectively. Power supply 10 supplies a regulated voltage to load 30 via output terminals 14 and 16 and power supply leads 32 and 34.

Sensing circuit 24 has a first input connected to sense terminal 20 and a second input connected to sense terminal 22. A resistor 40 is connected between output terminal 14 and sense terminal 20, and a resistor 42 is connected between output terminal 16 and sense terminal 22. The error signal produced by sensing circuit 24 depends on the voltage between sense terminals 20 and 22. Sensing circuit 24 is configured to provide negative feedback. Sense terminals 20 and 22 may be connected to load 30 by sense leads 50 and 52, respectively. In this configuration, sensing circuit 24 senses the voltage across load 30. As noted above, the voltage across load 30 may differ from the voltage between output terminals 14 and 16 due to the resistance of power supply leads 32 and 34.

Figure 2A:
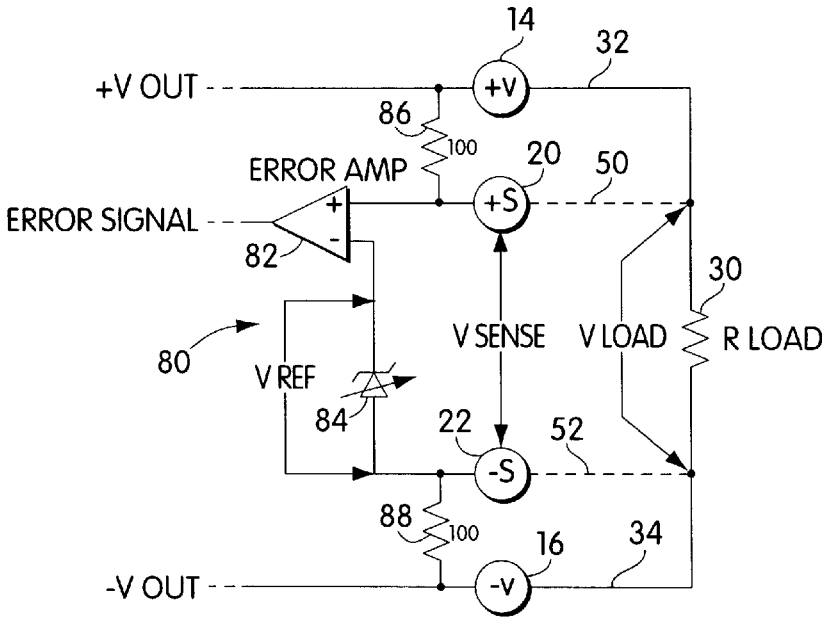
Fig. 2A PRIOR ART
FIG. 2A is a simplified partial schematic diagram of a prior art power supply configured for remote sensing.
Figure 2B:
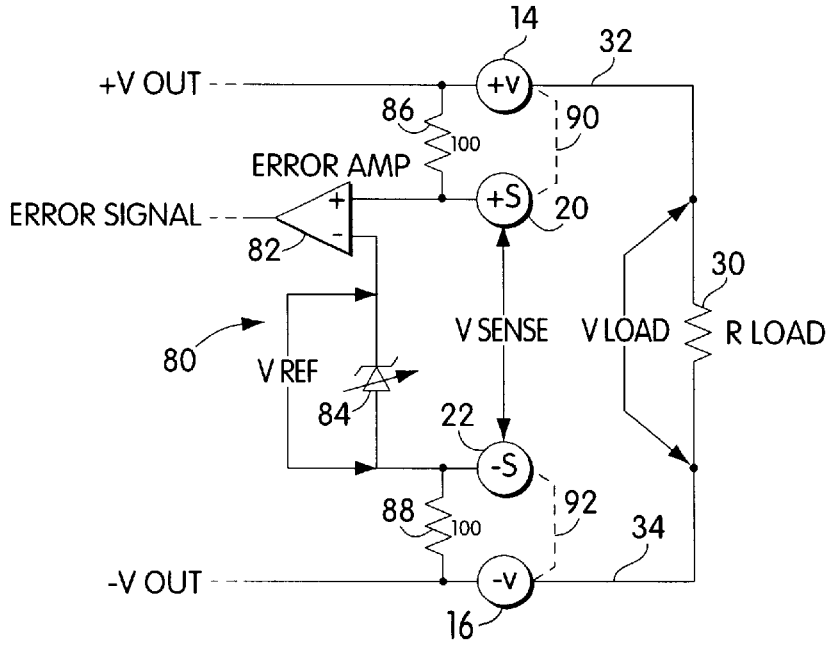
Fig. 2B PRIOR ART
FIG. 2B is a simplified partial schematic diagram of the power supply of FIG. 2A configured for local sensing.

A simplified partial schematic diagram of a prior art power supply configured for remote sensing is shown in FIG. 2A. A simplified partial schematic diagram of the prior art power supply of FIG. 2A configured for local sensing is shown in FIG. 2B. A sensing circuit 80, configured to provide negative feedback, includes an error amplifier 82 and a reference voltage source 84. Sense terminal 20 is connected to a positive input of error amplifier 82, and sense terminal 22 is connected through reference voltage source 84 to the negative input of error amplifier 82. The output of error amplifier 82 is the error signal, which represents the difference between the sense voltage $V_{SENSE}$ between sense terminals 20 and 22, and the reference voltage $V_{REF}$ produced by reference voltage source 84. A 100 ohm resistor 86, for example, may be connected between sense terminal 20 and output terminal 14, and a 100 ohm resistor 88, for example, may be connected between sense terminal 22 and output terminal 16.

In the remote sensing configuration, sense lead 50 is connected between sense terminal 20 and one side of load 30, and sense lead 52 is connected between sense terminal 22 and the other side of load 30. Sensing circuit 80 thus measures the voltage at load 30.

In the local sensing configuration of FIG. 2B, sense leads 50 and 52 are removed. A local sense lead 90 is connected between sense terminal 20 and output terminal 14, and a local sense lead 92 is connected between sense terminal 22 and output terminal 16. Sensing circuit 80 thus measures the voltage between output terminals 14 and 16. Each time the power supply is changed from remote sensing to local sensing, or vice versa, local sense leads 90 and 92 must be connected or disconnected.

Figure 3:
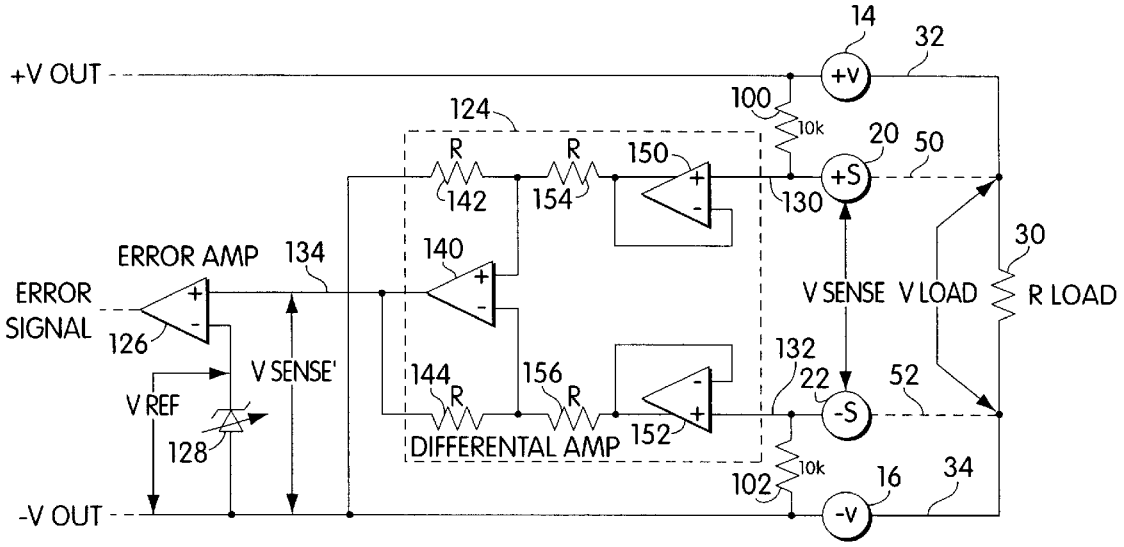
FIG. 3 is a simplified partial schematic diagram of an example of a power supply in accordance with the present invention.

A simplified partial schematic diagram of an example of a power supply in accordance with the present invention is shown in FIG. 3. For remote sensing, sense lead 50 is connected from sense terminal 20 to one end of load 30, and sense lead 52 is connected from sense terminal 22 to the other end of load 30. For local sensing, remote sense leads 50 and 52 are removed, but no connection is required between sense terminal 20 and output terminal 14 or between sense terminal 22 and output terminal 16. A 10 K ohm resistor 100 is connected between sense terminal 20 and output terminal 14, and a 10 K ohm resistor 102 is connected between sense terminal 22 and output terminal 16.

A sensing circuit 120 includes a differential amplifier 124, an error amplifier 126 and a reference voltage source 128. Sense terminal 20 is connected to a first input 130 of differential amplifier 124, and sense terminal 22 is connected to a second input 132 of differential amplifier 124. An output 134 of differential amplifier 124 is connected to a positive input of error amplifier 126. Reference voltage source 128 is connected between a negative input of error amplifier 126 and the negative output voltage −Vout of the power supply. The output of error amplifier 126 is the error signal supplied to voltage regulator 12 (FIG. 1).

Sensing circuit 120 is configured to provide negative feedback to voltage regulator 12. A variety of different negative feedback configurations may be utilized within the scope of the invention. For example, the input connections to differential amplifier 124 may be reversed if the sensing circuit 120 is provided with an additional 180° phase shift.

In the example of FIG. 3, differential amplifier 124 has a three operational amplifier configuration. In particular, an operational amplifier 140 has a positive input connected through a resistor 142 to the negative output voltage −Vout and has a negative input connected through a feedback resistor 144 to its output. The output of operational amplifier 140 is the output 134 of differential amplifier 124. Each of the operational amplifiers 150 and 152 is connected in a buffer amplifier configuration wherein the output is connected to a negative input. The buffer amplifier configuration provides high input impedance. Input 130 of differential amplifier 124 is connected to a positive input of operational amplifier 150, and input 132 of differential amplifier 124 is connected to a positive input of operational amplifier 152. Sense terminal 20 is thus connected through operational amplifier 150 and a resistor 154 to a positive input of operational amplifier 140. Sense terminal 22 is thus connected through operational amplifier 152 and a resistor 156 to the negative input of operational amplifier 140. In combination, the components of differential amplifier 154 form a unity gain amplifier having extremely low input bias current.

An example of a suitable differential amplifier 124 is the type INA114 precision instrumentation amplifier sold by Burr-Brown. This amplifier has an input bias current of 2 nanoamps maximum at 25° C. It will be understood that a variety of differential amplifiers may be utilized within the scope of the present invention. The differential amplifier 124 should have very low input bias current, preferably less than 25 nanoamps. The requirements for differential amplifier 124 can be satisfied by most three operational amplifier instrumentation amplifiers. Another requirement of differential amplifier 124 is that its power supply range must be high enough that its input common mode range is not exceeded. Differential amplifier 124 re-references the sense voltage $V_{SENSE}$ at inputs 130 and 132 to the negative output voltage −Vout. Thus, the output 134 of differential amplifier 124 and the reference voltage $V_{REF}$ produced by reference voltage source 128 are both referenced to the negative output voltage −Vout.

As indicated above, the power supply of FIG. 3 functions as a remote sensed power supply when sense leads 50 and 52 are connected to load 30 and functions as a locally sensed power supply when sense leads 50 and 52 are not connected. It is not necessary to connect sense terminal 20 to output terminal 14 or to connect sense terminal 22 to output terminal 16 for local sensing. The power supply thus operates in a remote sensing mode when sense leads 50 and 52 are connected to the load and automatically operates in a local sensing mode when sense leads 50 and 52 are not connected to the load.

As indicated above, differential amplifier 124 must have low input bias current to limit the voltage drop across resistors 100 and 102. This ensures that the sense voltage $V_{SENSE}$ between sense terminals 20 and 22 is very close to the voltage between output terminals 14 and 16. For the example of FIG. 3 where resistors 100 and 102 have values of 10 K ohms, each resistor has a voltage drop of 10 microvolts per nanoamp of bias current required by differential amplifier 124. Thus, in the above example where differential amplifier 124 has a maximum bias current of 2 nanoamps, the voltage drop across each resistor 100, 102 is 20 microvolts. Preferably, the voltage drop across each resistor 100, 102 is less than about 250 microvolts in the local sensing mode.

In the remote sensing mode, the power supply regulates the load voltage $V_{LOAD}$ at the load. In the remote sensing mode, resistors 100 and 102 cause a voltage division between the voltage sensed at the load and the voltage that appears at sense terminals 20 and 22 because of the resistance of sense leads 50 and 52. The resistor values should be chosen to limit the error caused by the voltage drop across sense leads 50 and 52. Where resistors 100 and 102 have values of 10 K ohms and each sense lead 50 and 52 has a resistance of 1 ohm, each sense lead has a voltage drop of approximately 10 microvolts per lead per 100 millivolts of voltage drop in the corresponding power supply lead 32 or 34. That is, the voltage drop across each sense lead 50, 52 is reduced by a factor of $10^{-4}$ in comparison with the voltage drop cross the corresponding power supply lead 32, 34.

In general, the values of resistors 100 and 102 are selected compromise between two conflicting requirements: (1) the need for a minimal or nearly minimal voltage drop across resistors 100 and 102 when the power supply is operated in local sensing mode (with sense leads 50 and 52 removed), and (2) the need for a minimal or nearly minimal voltage drop across sense leads 50 and 52 when the power supply is operated in the remote sensing mode. Both of these requirements are met satisfactorily by resistor values of 10 K ohms for typical parameter values set forth above. The values of resistors 100 and 102 are preferably in a range of about 1 K ohms to 100 K ohms, but are not limited to this range. It will be understood that the selection of resistor values depends on a number of factors, including the power supply voltage, the bias current required by the differential amplifier, the resistance of sense leads 50 and 52, and the desired power supply accuracy.

The present invention eliminates the need for the operator to make connections between the sense terminals and the output terminals of the supply when local sensing is utilized, thereby offering ease of use to the operator. The desired output voltage can be programmed into the power supply, and that voltage appears at the output terminals. The invention combines the convenience of a locally sensed laboratory power supply with the precision of a remote sensed laboratory power supply. The invention does not require the sense terminals to be located physically close to the output terminals, since they are not connected together for local sensing. The invention may be incorporated into general purpose laboratory power supplies to provide optional remote sensing, without adversely affecting the convenience of use of the general purpose laboratory power supply.

While there have been shown and described what are at present considered the preferred embodiments of the present invention, it will be obvious to those skilled in the art that various changes and modifications may be made therein without departing from the scope of the invention as defined by the appended claims.

I claim:

1. A power supply for supplying a regulated voltage to a load, comprising:

a voltage regulator for generating said regulated voltage in response to an input voltage and an error signal;

first and second output terminals connected to said voltage regulator for coupling the power supply to the load;

first and second sense terminals;

a sensing circuit for generating said error signal, said sensing circuit comprising a high input impedance differential amplifier having first and second inputs respectively coupled to said first and second sense terminals for measuring a sense voltage between said sense terminals;

a first resistor connected between said first output terminal and said first sense terminal; and a second resistor connected between said second output terminal and said second sense terminal, wherein said first and second resistors have values selected to produce a minimal or nearly minimal voltage difference between each of said output terminals and the respective sense terminals when said sense terminals are not connected to the load, and to produce a minimal or nearly minimal voltage difference between each of said sense terminals and respective sides of the load when said sense terminals are connected to the load.

2. A power supply as defined in claim 1 wherein said differential amplifier comprises an instrumentation amplifier.

3. A power supply as defined in claim 1 wherein said differential amplifier comprises an operational amplifier having first and second inputs, a first buffer amplifier coupled between said first sense terminal and the first input of said operational amplifier and a second buffer amplifier coupled between said second sense terminal and the second input of said operational amplifier.

4. A power supply as defined in claim 1 wherein said differential amplifier requires bias currents to said first and second inputs less than about 25 nanoamps.

5. A power supply as defined in claim 1 wherein said first and second resistors have values in a range of about 1 kilohms to 100 kilohms.

6. A power supply as defined in claim 1 wherein said first and second resistors each have values of about 10 kilohms.

7. A power supply for supplying a regulated voltage to a load, comprising:

a voltage regulator for generating said regulated voltage in response to an input voltage and an error signal;

first and second output terminals connected to said voltage regulator for coupling the power supply to the load;

first and second sense terminals;

a sensing circuit for generating said error signal, said sensing circuit comprising a high input impedance differential amplifier having first and second inputs respectively coupled to said first and second sense terminals for measuring a sense voltage between said sense terminals, said differential amplifier comprising an operational amplifier having first and second inputs, a first buffer amplifier coupled between said first sense terminal and the first input of said operational amplifier and a second buffer amplifier coupled between said second sense terminal and the second input of said operational amplifier;

a first resistor connected between said first output terminal and said first sense terminal; and a second resistor connected between said second output terminal and said second sense terminal.

8. A power supply as defined in claim 7 wherein said differential amplifier has input bias currents less than about 25 nanoamps.

9. A power supply as defined in claim 7 wherein said differential amplifier comprises an instrumentation amplifier.

10. A power supply as defined in claim 7 wherein said first and second resistors have values in a range of about 1 kilohms to 100 kilohms.

11. A power supply for supplying a regulated voltage to a load, comprising:

a voltage regulator for generating said regulated voltage in response to an input voltage and an error signal;

first and second output terminals connected to said voltage regulator for coupling the power supply to the load;

first and second sense terminals;

a sensing circuit for generating said error signal, said sensing circuit comprising a high input impedance differential amplifier having first and second inputs respectively coupled to said first and second sense terminals for measuring a sense voltage between said sense terminals;

a first resistor connected between said first output terminal and said first sense terminal; and a second resistor connected between said second output terminal and said second sense terminal, wherein said first and second resistors have values selected to produce a voltage difference less than about 250 microvolts between each of said output terminals and the respective sense terminals when said sense terminals are not connected to the load.

12. A power supply as defined in claim 11 wherein said differential amplifier comprises an instrumentation amplifier.

13. A power supply as defined in claim 11 wherein said differential amplifier comprises an operational amplifier having first and second inputs, a first buffer amplifier coupled between said first sense terminal and the first input of said operational amplifier and a second buffer amplifier coupled between said second sense terminal and the second input of said operational amplifier.

14. A power supply as defined in claim 11 wherein said differential amplifier requires bias currents to said first and second inputs less than about 25 nanoamps.

15. A power supply as defined in claim 11 wherein said first and second resistors have values in a range of about 1 kilohms to 100 kilohms.

* * * * *